US005904638A

United States Patent [19]

Habing et al.

[11] Patent Number: 5,904,638

[45] Date of Patent: May 18, 1999

[54] EXERCISE MACHINE ADJUSTMENT MECHANISM

[75] Inventors: Theodore G. Habing, Santa Ana; Frank Kilby, Lakewood, both of Calif.

[73] Assignee: Pacific Fitness Corporation, Cypress, Calif.

[21] Appl. No.: 08/680,009

[22] Filed: Jul. 15, 1996

Related U.S. Application Data

[63] Continuation-in-part of application No. 08/263,988, Jun. 29, 1994, Pat. No. 5,580,337.

[51] Int. Cl.[6] ..... A63B 21/00

[52] U.S. Cl. ..... 482/57; 482/908

[58] Field of Search ..... 482/57, 142, 908, 482/134, 145, 907, 136, 137, 138, 100; 601/23, 24, 34, 35, 36

[56] References Cited

U.S. PATENT DOCUMENTS

| | | | |
|---|---|---|---|
| 2,206,038 | 7/1940 | Lang Ford | 482/142 |
| 4,531,730 | 7/1985 | Chenera . | |
| 4,720,099 | 1/1988 | Carlson | 482/93 |
| 4,746,114 | 5/1988 | Grider | 482/142 |
| 4,776,583 | 10/1988 | Jennings . | |
| 5,060,939 | 10/1991 | Oswald et al. | 482/142 |
| 5,106,081 | 4/1992 | Webb | 482/137 |
| 5,284,464 | 2/1994 | Lee, III et al. . | |
| 5,338,274 | 8/1994 | Jones | 482/100 |
| 5,445,583 | 8/1995 | Habing | 482/52 |
| 5,580,337 | 12/1996 | Habing et al. | 482/142 |

*Primary Examiner*—Stephen R. Crow

*Attorney, Agent, or Firm*—Blakely, Sokoloff, Taylor & Zafman LLP

[57] ABSTRACT

An adjustment mechanism for an exercise machine enables the relative position between a support for the operator of the machine and an exercise member to be adjusted by the operator while in the exercise position. In a particular embodiment, the mechanism adjusts the longitudinal position of a pedal assembly of a recumbent bike exerciser. The operator is supported by a seat on a fixed frame member, and the pedal assembly is mounted on an extension member that slides longitudinally with respect to the fixed frame. Various mechanisms are provided for the operator to conveniently position the pedal assembly relative to the seat while the operator is seated in an exercising position.

5 Claims, 5 Drawing Sheets

EXERCISE MACHINE ADJUSTMENT MECHANISM

RELATED APPLICATION

This is a continuation-in-part of application Ser. No. 08/263,988 filed on Jun. 29, 1994, now U.S. Pat. No. 5,580,337.

BACKGROUND OF THE INVENTION

1. Field of the Invention

This invention relates generally to the field of exercise machines and particularly to a mechanism for adjusting the relative position between an operator's support and an exercise member.

2. Background

A popular type of exercise machine is the recumbent "bicycle". Such a machine typically provides a seat for the operator and a pedal mechanism similar to that used on a conventional bicycle. One of the design considerations for such a machine is accommodating operators of different stature. In this regard, it is necessary to make the distance between the operator's seat and the pedal assembly adjustable in accordance with the length of the operator's legs. Optimum effectiveness of the exercise can only be achieved when this distance is properly adjusted. Similar concerns are involved with other types of exercise machines where it is necessary or desirable to adjust the distance between a fixed support for the operator and the position of an exercise member.

In the case of a recumbent leg exerciser and similar exercise machines, it is common practice to make the operator's seat longitudinally adjustable along the frame of the machine in order to provide the necessary adjustment. This is typically accomplished by means of a telescopic or sliding assembly with a pin and/or a tightening knob to retain the seat in a desired position. In order to adjust the seat in this manner, it is often not possible for the operator to remain in the seat. Even if the operator is able to release the seat retention device while seated, the seat will then be difficult to control within its range of adjustment since there is no provision for fine incremental positioning. This makes it virtually impossible to adjust the seat while in the midst of an exercise routine.

It would be far preferable for the operator to be able to conveniently adjust the relative distance between the seat and the pedal assembly in fine increments while seated in the exercise position and while performing the exercise. With such a capability, there is no need for the operator to break stride in order to achieve a more comfortable or more efficacious exercise position.

SUMMARY OF THE INVENTION

The present invention provides an adjustment mechanism particularly adapted for adjusting the relative distance between the operator's seat and the pedal assembly of a recumbent leg exercising machine. However, the invention has more general application in various types of exercise machines, such as leg press, leg curl and leg extension machines, where it is necessary or desirable to adjust the relative distance between an operator's support and an exercise member. In the case of a recumbent leg exerciser as described herein, the operator's seat is carried on a fixed frame. A pedal assembly is carried on an extension member that slides longitudinally with respect to the fixed frame.

The pedal assembly is positioned relative to the operator's seat by a mechanism that can be conveniently operated while the operator remains seated in an exercising position. In one embodiment, a handle extends upwardly adjacent to the operator's seat and is operatively coupled to a rack and pinion assembly for positioning the pedal assembly. In alternative embodiments, the handle is operatively coupled to a chain and sprocket assembly or a cable and drum assembly. The handle may be positively operated to move the pedal assembly both forwardly and rearwardly. Alternatively, a release mechanism may be provided so that the operator can simply push the pedal assembly forwardly with his or her feet and can operatively engage the handle to move the pedal assembly rearwardly. In still another embodiment, a cylinder and piston assembly is used to move the pedal assembly rearwardly. With this latter arrangement, the release mechanism is preferably operated by a lever disposed on a handlebar of the machine.

The operator's seat preferably includes a separate back support cushion that is adjustable for rake angle. The back support cushion is retained in position by a spring loaded pin. The pin is released by actuation of a second lever disposed on a handlebar of the machine.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known aspects of exercise machines are omitted so as to not obscure the description of the present invention with unnecessary detail.

Figure 1:
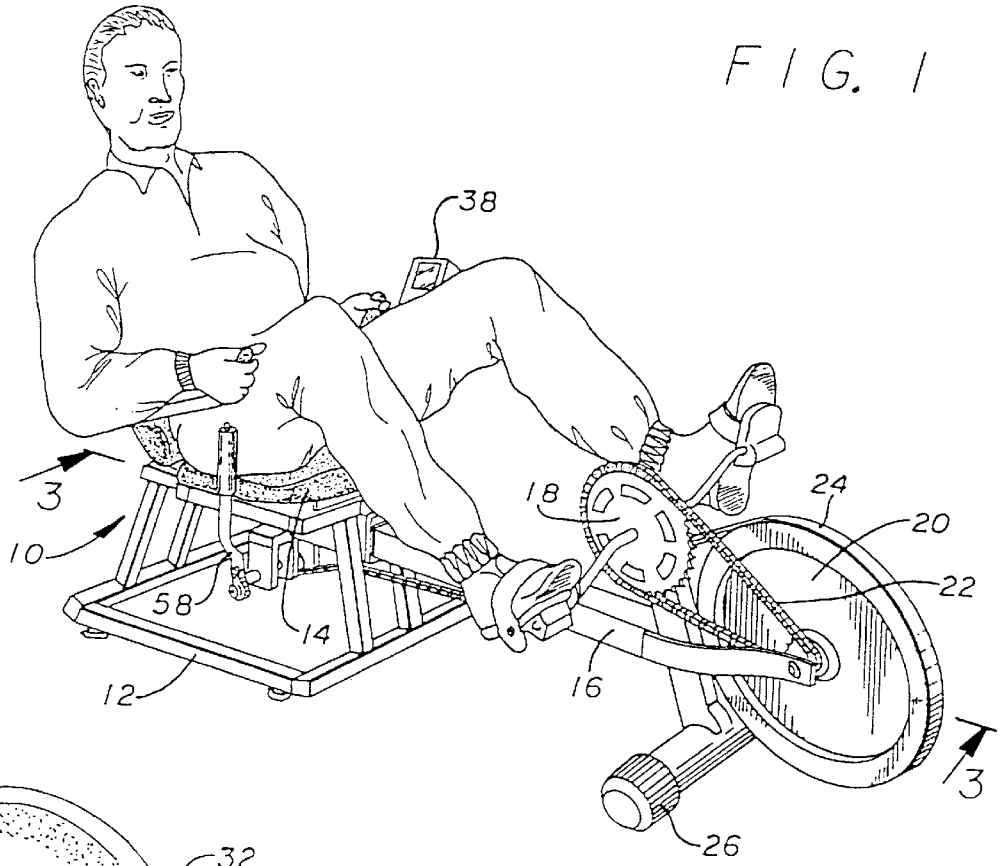
FIG. 1 is a perspective view of a recumbent leg exercise machine in accordance with the present invention.

FIG. 1 generally illustrates an exercise apparatus 10 constructed in accordance with the present invention. Apparatus 10 comprises a fixed frame portion 12 providing a seat 14 for the operator of the apparatus. A forward extension member 16 is slidably coupled to the fixed frame 12 as will be more fully described below. Forward extension 16 is preferably mounted on wheels 26 to facilitate adjustment of the longitudinal position of pedal and crank assembly 18 in the manner that will be subsequently described.

A pedal and sprocket assembly 18 is rotatably mounted to the forward extension member and drives a flywheel 20 by means of coupling chain 22. The rotation of flywheel 20 is retarded by means of belt 24, the tension of which can be manually adjusted by conventional means (not shown). The tension in belt 24 provides a braking action on flywheel 20 and thereby provides exercise resistance to the user of the apparatus. Although apparatus 10 is illustrated with a friction belt, it will be recognized that other means for providing exercise resistance may be employed. In particular, various electronically controlled resistance devices may be advantageously combined with the present invention. These include, for example, electrical generators and magnetic particle clutches.

Figure 2:
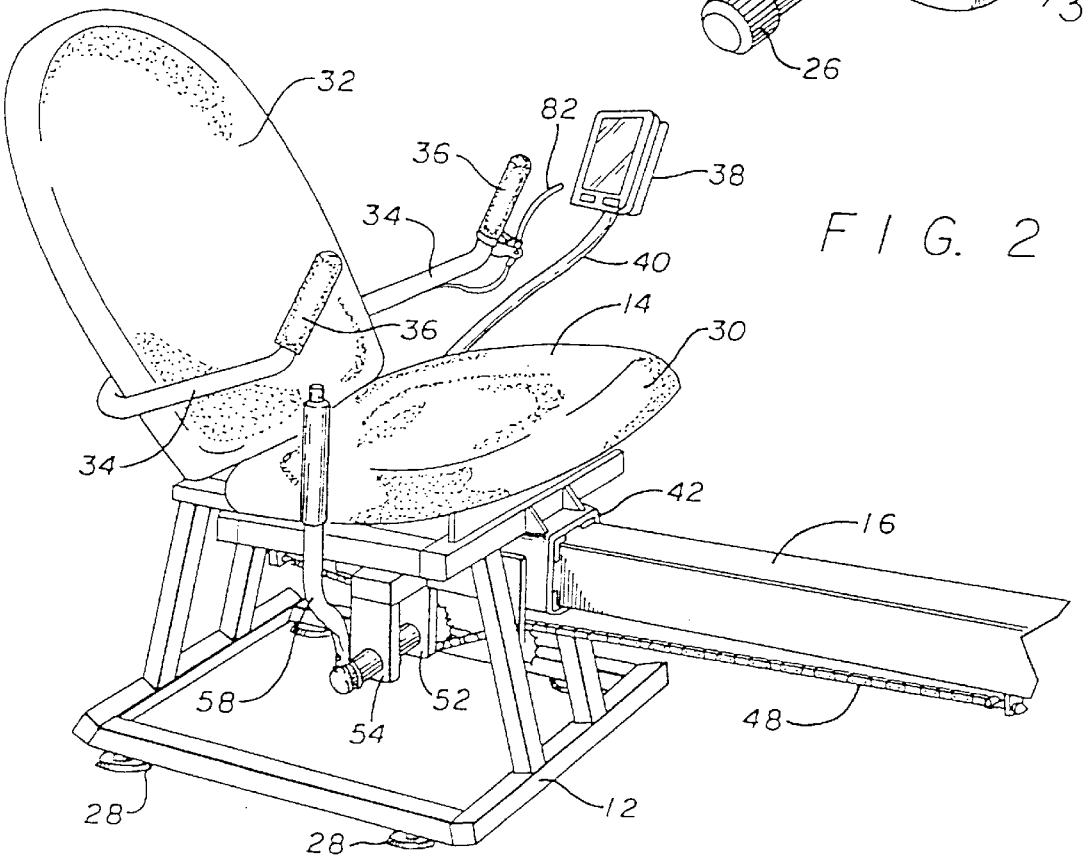
FIG. 2 is a detailed perspective view of the operator's seat of the machine of FIG. 1.

Referring now to FIG. 2, further details of fixed frame portion 12 and seat 14 are evident. The principal structural elements of fixed frame portion 12 may be conveniently constructed with 30 mm square section steel tubing; however, other methods of construction as are conventionally used for exercise equipment may be employed. Frame 12 is supported by feet 28 which preferably incorporate a threaded height adjustment so that frame 12 can be easily leveled on an uneven supporting surface.

Seat 14 comprises a lower seat cushion 30 and a back support cushion 32. Although a unitary seat could be employed, it is preferable to have separate lower and back support cushions so that the rake of the back support cushion may be made adjustable. A pair of handlebars 34 extend forwardly on each side of back support cushion 32. Handlebars 34 terminate at hand grips 36, which are preferably provided with cushioned covers for the comfort of the operator. A console 38 extends from fixed frame 12 on a stalk 40. Alternatively, stalk 40 may be mounted to back support cushion 32 so that the console will move with the back support as it is adjusted. Console 38 provides displays to the operator that report on the progress of the exercise session. For example, such displays may include elapsed time, elapsed distance, speed and the like. In certain embodiments, console 38 may also include operator controls for the level of exercise resistance or other features.

Figures 3, 4:
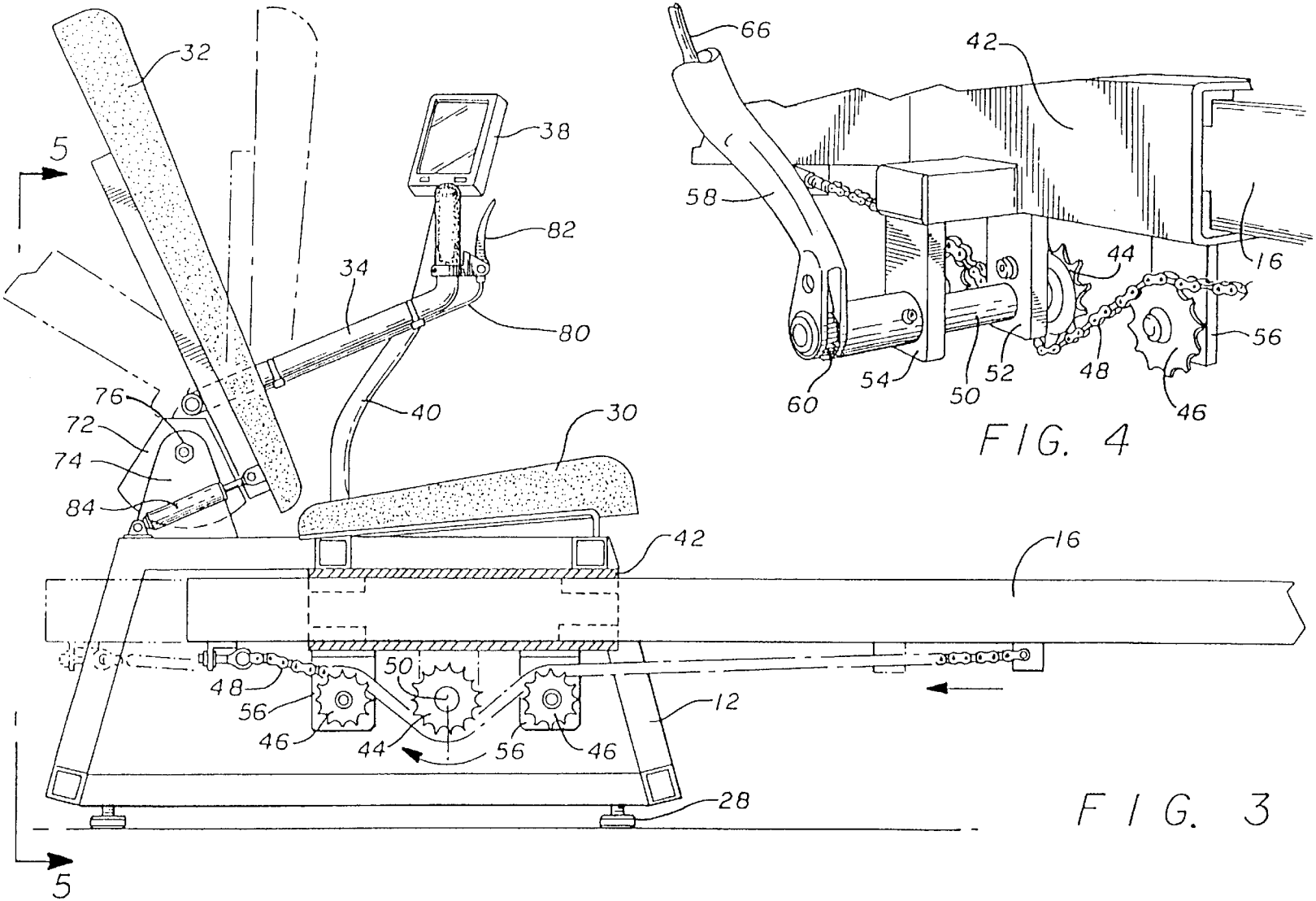
FIG. 3 is a partial cross sectional view taken through line 3—3 of FIG. 1.
FIG. 4 is a detailed perspective view of the adjustment mechanism.
Figure 5:
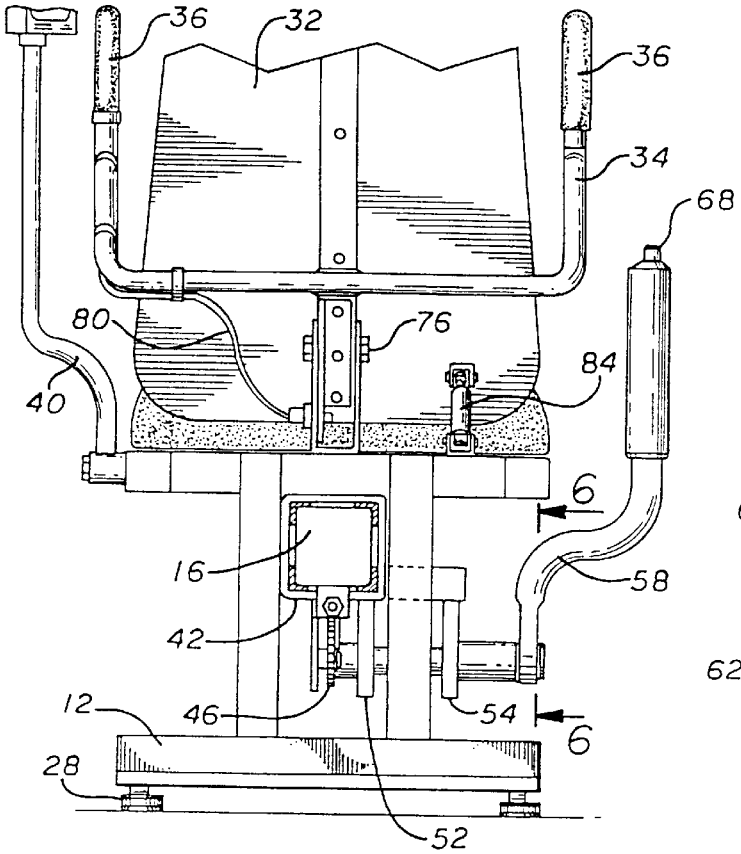
FIG. 5 is a rear elevation view of the exercise machine shown in the preceding figures.

With reference next to FIGS. 3–5, the mechanism for adjusting the longitudinal position of forward extension 16 relative to the fixed frame 12 is illustrated. Fixed frame 12 includes a large section tubular member 42 which telescopically receives forward extension 16. Tubular member 42 supports drive sprocket 44 and a pair of idler sprockets 46. Sprockets 44 and 46 engage chain 48, which is secured at each end thereof to extension member 16. Drive sprocket 44 is secured to shaft 50, which is rotatably supported by brackets 52 and 54. Brackets 52 and 54 are welded or otherwise secured to tubular member 42. Idler sprockets 46 are rotatably mounted on respective brackets 56, which are likewise welded or otherwise secured to tubular member 42. It will be observed that rotation of drive sprocket 44 effectuates longitudinal movement of extension member 16. Although not shown in the drawings, a shroud is preferably provided to enclose sprockets 44, 46 and chain 48. In an alternative arrangement, chain 48 may be disposed within extension member 16, in which case an elongated slot would be provided in the bottom wall of member 16 through which the sprockets would engage the chain.

Figure 6:
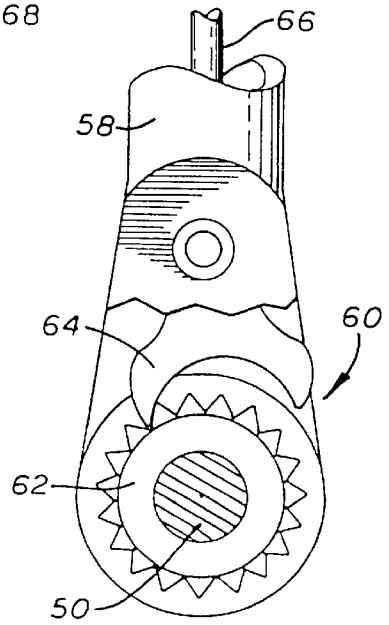
FIG. 6 is a detailed cross sectional view of the ratchet assembly taken through line 6—6 of FIG. 5.

A handle 58 is coupled to shaft 50 through ratchet assembly 60. As best seen in FIGS. 1 and 2, handle 58 extends upwardly adjacent to lower cushion 30 where it may be conveniently operated by the user of the apparatus. A detailed view of ratchet assembly 60 is shown in FIG. 6. Ratchet wheel 62 is mounted to shaft 50 and cooperates with reversible pawl 64. Pawl 64 is controlled by means of flexible shaft 66, which is actuated by means of button 68 at the top of handle 58. Thus, operation of handle 58 will normally cause extension 16 to retract rearwardly with respect to fixed frame 12, whereas operation of handle 58 while button 68 is depressed will cause extension 16 to extend forwardly. In either case, the user of the apparatus maintains positive control over the adjustment of the position of pedal and crank assembly 18 relative to the seat 14. This is in contrast to prior art devices in which the release of a seat adjustment lock allows the seat to slide freely along the fame, thereby precluding adjustment during the course of an exercise routine.

In an alternative arrangement, depression of button 68 may simply release pawl 64 from ratchet wheel 62 so that the operator can push against the pedal assembly to move extension member 16 to an extended position. With button 68 released, operation of handle 58 will cause extension member 16 to retract rearwardly as described above.

Figure 8:
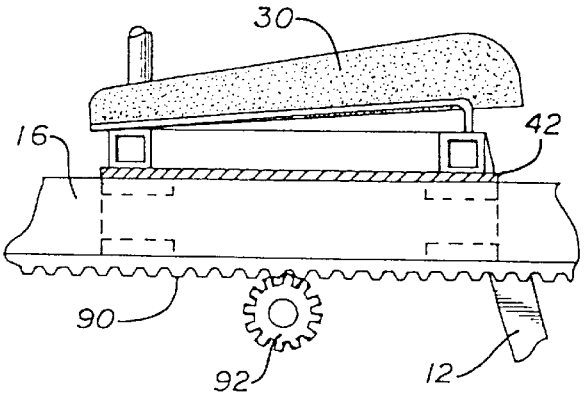
FIG. 8 is a partial cross sectional view of an alternative embodiment of the adjustment mechanism.

The present invention is not limited to the chain and sprocket arrangement as just described. In an alternative embodiment illustrated in FIG. 8, a rack 90 may be disposed along the length of extension member 16 for mating engagement with a pinion gear 92 mounted on shaft 50. In this embodiment, no functional equivalents to idler sprockets 46 are required. In still a further alternative embodiment, a lever acting directly on extension member 16 may be employed. In this arrangement, the lever preferably has a fulcrum on the lowest structural member of fixed frame 12 and a handle for the operator at the upper end of the lever. At an intermediate position along its length, the lever engages the extension member 16, whereby the operator's actuation of the lever handle causes the extension member to move in a longitudinal direction. This latter embodiment does not offer the same degree of control that can be achieved with a chain and sprocket or rack and pinion arrangement.

Figure 9:
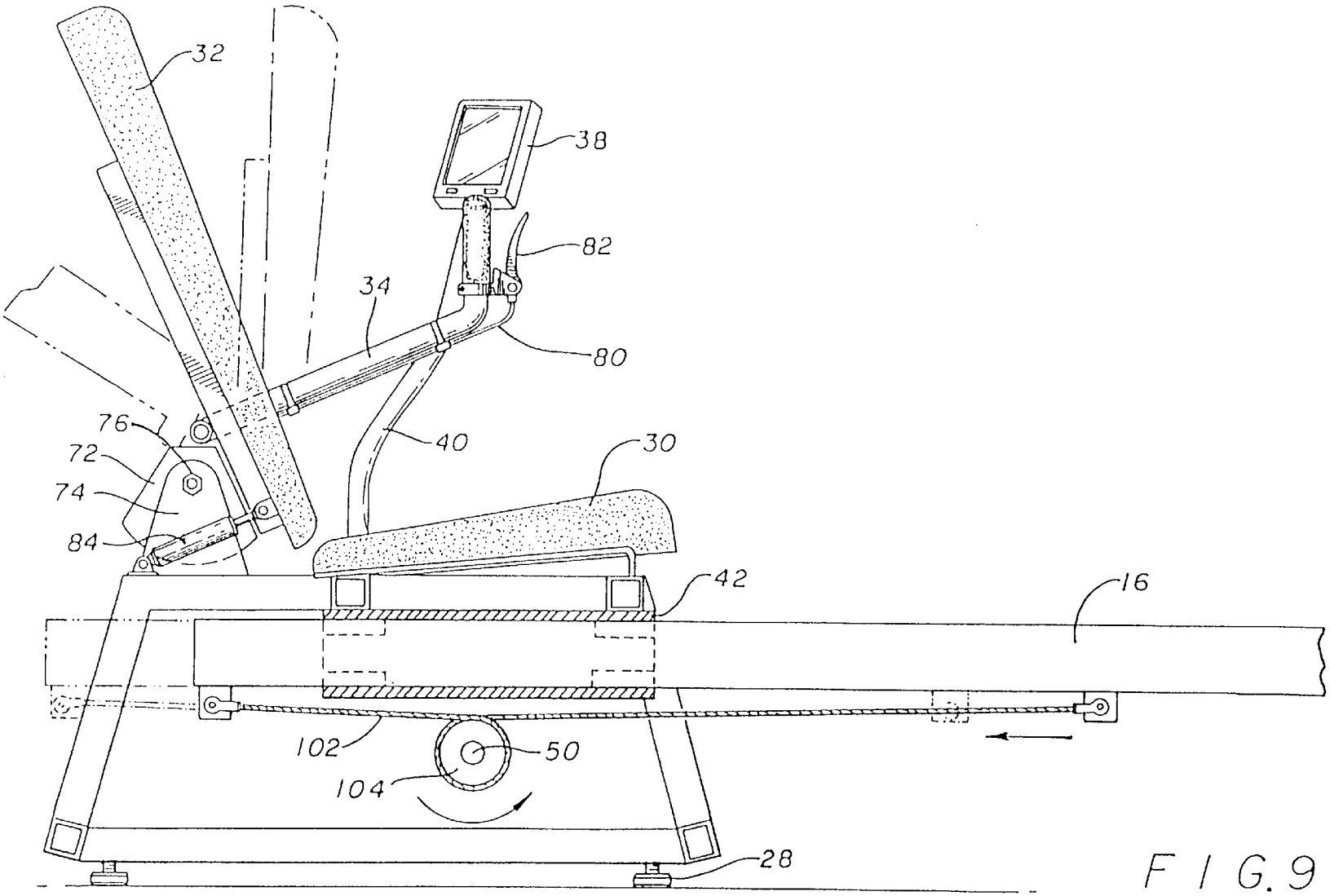
FIG. 9 is a partial cross sectional view of another alternative embodiment of the adjustment mechanism.

FIG. 9 illustrates still another alternative embodiment of an adjustment mechanism according to the present invention. In this embodiment, a cable 102 is secured at opposite ends thereof to extension member 16. A drum 104 is secured to shaft 50, which is supported and operated in the same manner as previously described in connection with FIGS. 3–5. Cable 102 is wrapped around drum 104 at least one complete turn and preferably more so as to minimize slippage of cable 102 against the surface of drum 104. Drum 104 is rotated by operation of handle 58 as previously described.

Figure 7:
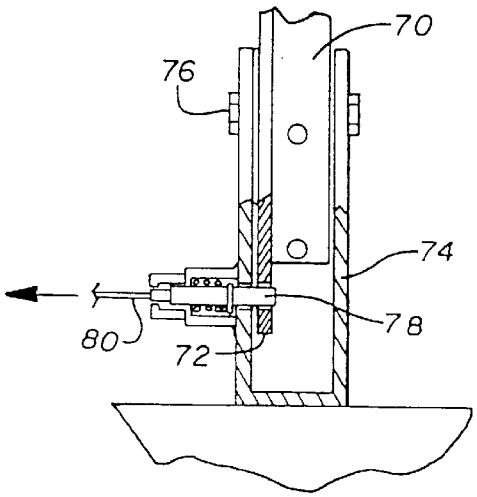
FIG. 7 is a partial cross sectional view showing the back support retaining mechanism.

As previously mentioned, the rake of back support cushion 32 is preferably adjustable for the comfort of the operator and to vary the muscular emphasis of the exercise. With reference primarily to FIGS. 3 and 7, back support cushion 32 is mounted on a supporting member 70, which has a sector plate 72 attached thereto. The back support assembly is pivotally supported by bracket 74, which is rigidly mounted to the fixed frame 12. Sector plate 72 is provided with a plurality of holes (not shown) that are disposed in an arc about pivot point 76. A spring loaded pin 78 engages a selected one of the holes to hold the back support assembly in a desired position. Pin 78 is retracted by means of choke cable 80, which is operated by lever 82 mounted on handle bar 34. The back support assembly is biased to an upright position by a gas filled cylinder 84. To adjust the back support, the operator first pulls lever 82 to disengage pin 78. The operator may then move the back support to the approximate desired position by leaning his torso forward or backward or by pushing or pulling on handlebar assembly 34. Lever 82 is then released so that pin 78 may engage the hole closest to the desired position.

Figure 10:
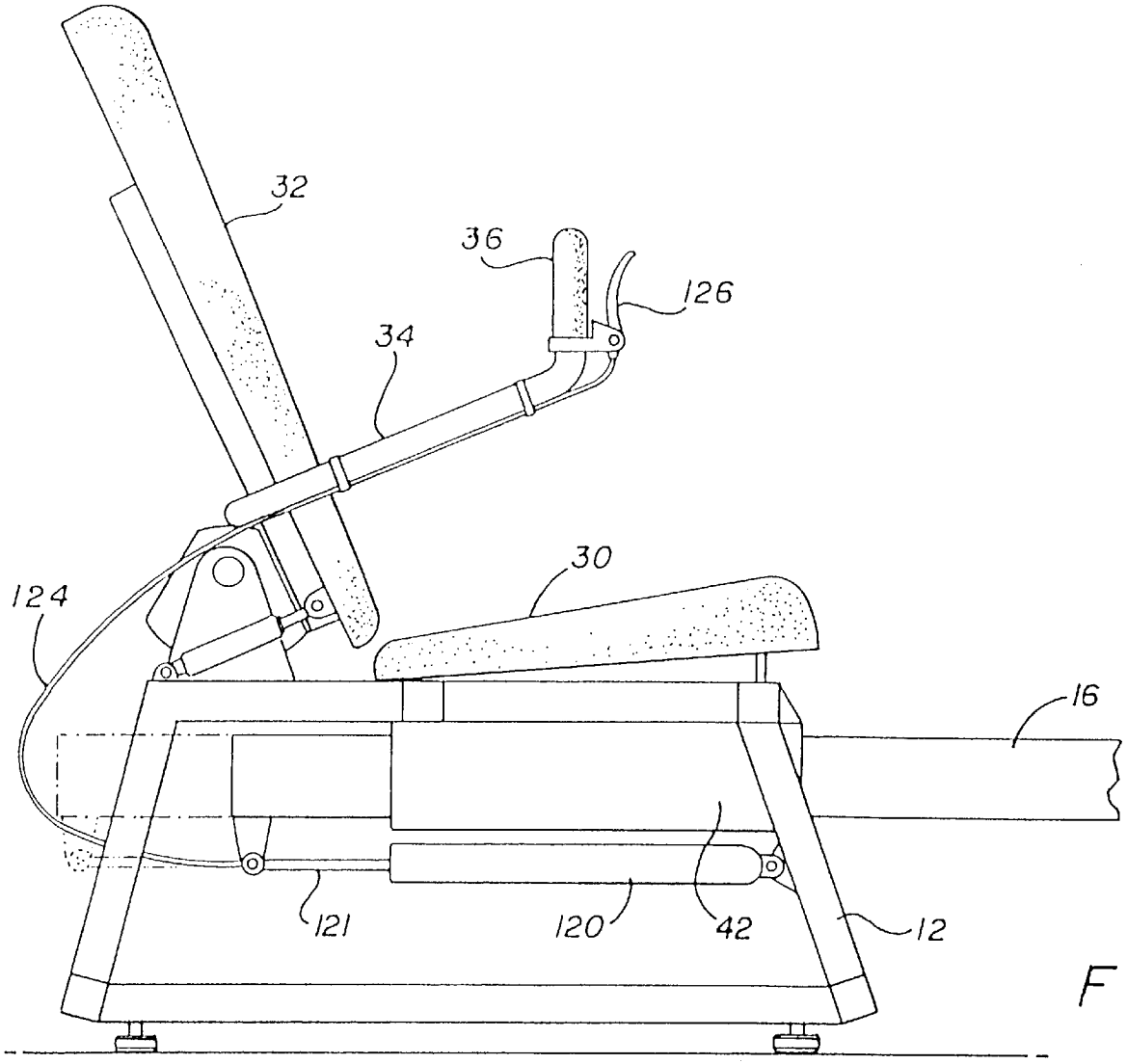
FIG. 10 is a side elevation view of another alternative embodiment of the adjustment mechanism.

Yet another alternative embodiment of the invention is illustrated in FIG. 10. In this embodiment, a locking gas spring cylinder 120 is coupled between the fixed frame 12 and extension member 16. When unlocked, cylinder 120 urges extension member 16 rearwardly, thereby bringing the pedal assembly closer to the operator. Extension member 16 is secured at a selected position upon locking engagement of piston 121 in cylinder 120. It is preferred that the operator be able to lock and unlock cylinder 120 without having to reach from the normal exercise position. Thus, a release for the cylinder lock may be conveniently provided as a lever 126, similar in operation to lever 82, on handlebar 34. Lever 126 operatively communicates with cylinder/piston assembly 120/121 through cable 124. Once seated in apparatus 10, the operator simply releases the cylinder lock with lever 126 and pushes against the pedal assembly or allows the pedal assembly to retract under the influence of cylinder 120 until the operator's legs are extended in a comfortable exercise position. Lever 126 is then released to lock extension member 16 in place. It will be recognized that a spring could be used in lieu of cylinder 120 as a means for urging extension member 16 in a rearward direction. Furthermore, an alternative arrangement for securing extension member 16 would be by placement of a pin on tubular member 42 into one of a plurality of holes in the extension member.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An exercise machine comprising:

a first frame;

a support for an operator of the exercise machine, said support mounted on the first frame;

a second frame movably coupled to the first frame;

an exercise member mounted on the second frame for exercise operation by a limb of the operator;

a drum rotatably mounted on the first frame;

a cable coupled to the second frame and wound around the drum;

a handle disposed adjacent to the support for the operator and coupled to the drum;

whereby operation of the handle rotates the drum and causes a corresponding displacement of the exercise member in relation to the support for the operator.

2. The apparatus of claim 1 wherein the support for the operator is a seat and the exercise member comprises a pedal mechanism for exercise operation by the operator's feet.

3. The apparatus of claim 2 further comprising handlebars disposed adjacent to the operator's seat.

4. The apparatus of claim 3 wherein the operator's seat includes a back support cushion pivotally mounted on a transverse axis so as to be adjustable for rake angle.

5. The apparatus of claim 4 further comprising a release mechanism for the back support cushion, said release mechanism having an actuator mounted on the handlebars.

* * * * *